US005104167A

United States Patent [19]

Nemeth

[11] Patent Number: 5,104,167

[45] Date of Patent: Apr. 14, 1992

[54] BOOK HOLDER

[76] Inventor: Stephen R. Nemeth, 10501 Wilshire Blvd., Suite 814, Los Angeles, Calif. 90024

[21] Appl. No.: 607,281

[22] Filed: Oct. 31, 1990

[51] Int. Cl.[5] ..... B42D 17/00

[52] U.S. Cl. ..... 294/137; 281/43; 281/45; 294/158

[58] Field of Search ..... 294/137, 138, 145, 148, 294/151, 153, 158, 159, 164-170; 206/450, 472; 211/42; 248/441.1, 445, 450; 229/117.19, 117.24-117.25; 281/42-50; 383/6, 13, 24, 25; 312/183, 184

[56] References Cited

U.S. PATENT DOCUMENTS

| | | | |
|---|---|---|---|
| 1,034,221 | 7/1912 | Dutton | 281/43 |
| 1,334,020 | 3/1920 | Davision | 281/43 X |
| 1,548,248 | 8/1925 | Binns et al. | 281/43 X |
| 1,764,325 | 6/1930 | Lupien | 281/49 |
| 1,909,519 | 5/1933 | Braunstein | 281/49 |
| 2,490,147 | 12/1949 | Minton | 281/42 |
| 2,576,783 | 11/1951 | Dewey | 281/42 X |
| 2,983,415 | 5/1961 | Cooley | 294/159 |
| 3,016,036 | 1/1962 | Jorgensen | 281/42 X |
| 3,174,626 | 3/1965 | West | 294/158 X |
| 3,790,242 | 2/1974 | Sullivan | 294/170 X |
| 4,072,407 | 2/1978 | Zeisky | 281/42 X |

FOREIGN PATENT DOCUMENTS

| | | | |
|---|---|---|---|
| 1190938 | 10/1959 | France | 281/47 |
| 2242949 | 4/1975 | France | 294/168 |
| 1174006 | 12/1969 | United Kingdom | 281/47 |
| 2112714 | 7/1983 | United Kingdom | 281/43 |

*Primary Examiner*—Johnny D. Cherry
*Attorney, Agent, or Firm*—William L. Klima

[57] ABSTRACT

A flat handle for hand-carrying a heavy, large book; the handle including a lower bar over which the book is draped, a spaced apart upper bar having a handhold for being held in a hand, and a pair of opposite side legs connecting between the bars; the device being molded of relatively rigid plastic.

12 Claims, 1 Drawing Sheet

BOOK HOLDER

BACKGROUND OF THE INVENTION

1. Field of the Invention

This invention relates generally to handles for conveniently carrying by hand a heavy, large, voluminous book as thick as a telephone directory, an encyclopedical Sears Roebuck catalogue or a multiple listing service compendium used by real estate brokers. Numerous salesmen in almost every trade carry sample books showing their products when calling on prospective customers. For example: salesmen of floor carpeting, wallpaper or drapery fabrics carry big sample books to the homes or places of business of their prospects so that they can more readily decide from the large samples presented, which of them harmonizes with the decor of the home or office. Real estate brokers often carry a M.L.S. compendium when going with a prospect to look at several properties. Taking it along eliminates the chore of hand-copying or photo-copying from it instead, before leaving, so all details of each property can be presented at the time while being visited. And if the prospect is not pleased with any, then the handy book permits looking yet at others for still a possibility of accomplishing a sale.

2. Prior Art

In the past such weighty reference books have been carried under an arm while being grasped underneath by a hand which was tiring. So more recently, various handles have been developed to carry them easier, as is evident by U.S. Pat. Nos. 1,334,020 to Davison, 3,174,626 to West and 4,132,501 to Simpson. However, none of these are fully ideal so there is still need of some further improvement.

SUMMARY OF THE INVENTION

Accordingly, it is a principal object of the present invention to provide a book holder which is very simple in design and is inexpensive to manufacture.

Another object is to provide a book holder which in one design thereof comprises only a single part that is either stamped out from a flat sheet of plastic or is plastic cast in a mold so to be quickly manufactured in mass production.

Yet another object is to provide a book holder which may be made for holding either a real estate multiple listing service compendium or any other trade book.

Yet another object is to provide a self-contained Holder for Books that are sometimes too large or take up too much room in a briefcase. In effect, it becomes its own briefcase.

Other objects are to provide a book holder which is strong for holding great weight, takes up a minimum space, does not damage a supported book, does not hinder in the use of the supported book, and which permits hanging the book on a wall hook when not in use so to prevent cluttering a desk.

These and other objects will be readily evident upon a study of the following specification and the accompanying drawing.

DETAILED DESCRIPTION OF PREFERRED EMBODIMENTS

Figure 3:
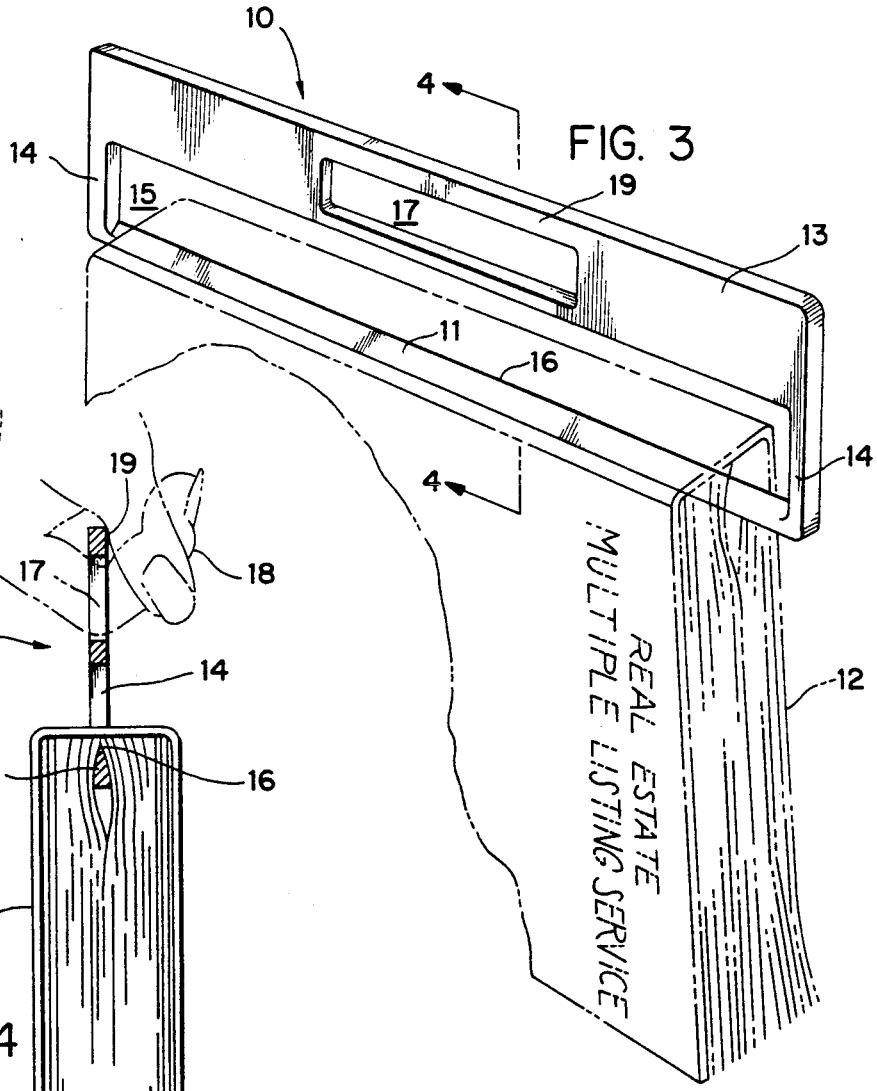
FIG. 3 is a perspective view thereof shown supporting a book.
Figure 4:
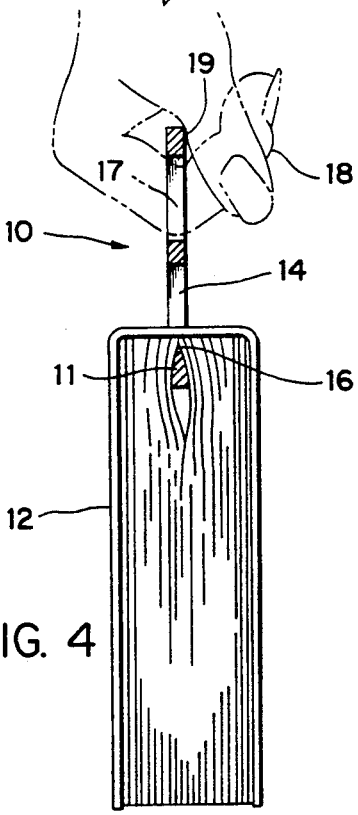
FIG. 4 is a cross sectional view taken on line 4—4 of FIG. 3.

Referring now to the drawing in greater detail, the reference numeral 10 represents a book holder according to the present invention wherein the same comprises an elongated, one piece member that is either die-cut from a flat sheet of plastic or is molded of a relatively rigid plastic material. It comprises a horizontal lower bar 11 over which a book 12 is rested, a horizontal upper bar 13 in spaced relation to the lower bar and a pair of vertical legs 14 between the ends of the two bars so as to enclose a space 15 (opening) therebetween through which one-half of the book is inserted when being installed over the bar 11 so as to drape downwardly therefrom. As shown in FIGS. 3 and 4, the bar 11 is upwardly tapered so as to form a blade-like thin upper edge 16 in order to fit as closely as possible to the spine of the book when rested thereacross. The upper bar is relatively wide so it includes a central opening 17 for receiving a person's fingers 18 therethrough in order to grasp around a handhold 19 when carrying a book.

The book holder is designed for carrying a book by hand. The elongated body is substantially flat and includes the substantially horizontally oriented lower bar 11 and the substantially horizontally oriented upper bar 13 with the upper bar having an opening therethrough of a shape and size to accommodate a person's hand. Specifically, as shown in FIG. 4, a person's hand just fits through this opening and the person's hand is maintained substantially in the center of the holder due the limited width of the opening when viewing the holder from the side as shown in FIG. 3. The set of legs connecting the bars 11,13 together at respective ends of the bars have substantially the same length so as to space said bars apart substantially in parallel relationship. The bars 11,13 and the legs 14,14 define the opening 15 through said elongated body of sufficient size and shape so as to allow a portion of the book to be passed through the opening and drape over the lower bar 11 during operation, as shown in FIG. 4. Further, the opening through the upper bar 13 for accommodating a person's hand is substantially rectangular and oriented substantially parallel with said bars 11,13.

Figure 1:
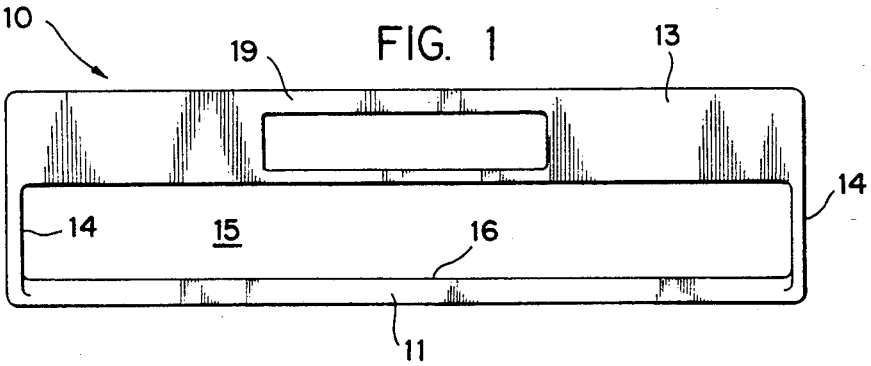
FIG. 1 is a side elevational view of the book holder invention.
Figure 2:
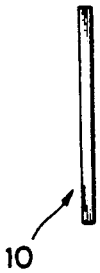
FIG. 2 is an end elevational view thereof.

The lower bar 11 has substantially a constant cross-section, as shown in FIGS. 1 and 4 (i.e. width, height and shape remain the same throughout its length). The upper bar 13 is substantially thicker in height relative to said lower bar, as shown in FIG. 1. Further, the upper bar 13 is substantially rectangular in shape when the holder 10 is viewed from the side. Also, the lower bar 11 is substantially rectangular in shape when the holder is viewed from the side.

In the embodiment shown in the Figures, the legs 14,14 are thinner relative to the horizontal bars 11,13 when viewing the holder from the side. This feature allows bending of the legs 14,14 during operation for the reason set forth below. Further, the lower bar 11 has a substantially triangular cross-section, as shown in FIG. 4. Also, upper bar 13 includes portions having substantially rectangular cross-sections, as shown in FIG. 4.

A portion of the upper bar 13 positioned above the opening to accommodate a person's hand is thicker as compared with a portion of the upper bar 13 positioned below the opening accommodating a person's hand when viewing the holder from the side. Further, the legs 14,14 are substantially shorter in dimension compared with the length of the horizontal bars 11,13 to provide an opening through the elongated body that has a length dimension substantially greater that its height dimension. Also, the opening through the upper bar 13 for accommodating a person's hand is positioned in close proximity to the opening through the elongated portion for accommodating a portion of the book.

In operative use, the book may be rested upon any surface and opened up for referring to any page without interference by the holder.

In a modified design of the invention, the thickness of legs 14 may be made less than the thickness of bars 11 and 13 so to be readily bendable in order that when the book is laid upon a table, the bar 13 under the book, lays flat upon the tabletop while the bar 11 lays down flat between its adjacent pages, so the page being read also lays flat instead of bulging upward over a raised bar.

In yet another design, the lower portion of one leg has a flat, flexible tongue molded on the leg opposite sides, each tongue being a few inches long and having a free end normally resting adjacent one side of the bar 11. The tongue is longitudinally slitted forming tabs for use as page markers which may be inserted between pages of the book.

While various other modifications or changes may be made, it is understood that such variations will be within the spirit and scope of the present invention as is defined by the appended claims.

What I claim as new, is:

1. A book holder for carrying a book by hand, comprising:

a substantially flat elongated body, said body including:

a lower bar, said lower bar having a substantially constant cross-section;

an upper bar, said upper bar having a first opening means therethrough of a shape and size for accommodating a person's hand;

a set of leg means for connecting said bars together substantially at respective ends of said bars, said leg means being substantially the same length so as to space said bars apart substantially in parallel relationship, said leg means are thinner relative to said bars when viewing said holder from the side for allowing the leg means to be readily bendable in order that when the book is laid upon a support, said upper bar lays flat under the book upon the support while said lower bar lays down flat between adjacent pages of the book so that the page being read also lays flat instead of bulging upward, said bars and said leg means defining a second opening means through said elongated body of sufficient size and shape for allowing a portion of a book of substantial thickness to be passed through said second opening means and drape over said lower bar during operation.

2. A book holder according to claim 1, wherein said first opening means through said upper bar is substantially rectangular and oriented substantially parallel with said bars.

3. A book holder according to claim 1, wherein said upper bar is substantially thicker in height relative to said lower bar.

4. A book holder according to claim 3, wherein said upper bar is substantially rectangular in shape when the holder is viewed from the side.

5. A book holder according to claim 4, wherein said lower bar is substantially rectangular in shape when the holder is viewed from the side.

6. A book holder according to claim 1, wherein said lower bar has a substantially triangular cross-section.

7. A book holder according to claim 6, wherein said first opening means through said first bar is defined by upper and lower bar sections having substantially rectangular cross-sections.

8. A book holder according to claim 7, wherein said elongated body is substantially flat in configuration.

9. A book holder according to claim 1, wherein said first opening means through said first bar is defined by upper and lower bar sections having substantially rectangular cross-sections.

10. A book holder according to claim 1, wherein an upper bar section of said upper bar positioned above said first opening means to accommodate a person's hand is thicker as compared with a lower bar section of said upper bar positioned below said first opening means when viewing the holder from the side.

11. A book holder according to claim 1, wherein said leg means are substantially shorter in dimension compared with the length of said bars defining said second opening means through said elongated body for accommodating a portion of the book that has a length dimension substantially greater than its height dimension.

12. A book holder according to claim 11, wherein said first opening means through said upper bar for accommodating a person's hand is positioned in close proximity to said second opening means through said elongated body for accommodating a portion of the book.

* * * * *